United States Patent [19]

Lassy et al.

[11] 3,930,490

[45] Jan. 6, 1976

[54] FIREPLACE HEATER

[76] Inventors: Carl O. Lassy, 376 South St.; William A. Lassy, 73 Grove Ave., both of Bristol, Conn. 06010

[22] Filed: Mar. 25, 1974

[21] Appl. No.: 454,743

[52] U.S. Cl. ..... 126/121
[51] Int. Cl.[2] ..... F24B 7/00
[58] Field of Search ..... 126/121

[56] References Cited

UNITED STATES PATENTS

| | | | |
|---|---|---|---|
| 737,382 | 8/1903 | Frederick | 126/121 |
| 1,313,085 | 8/1919 | Greene | 126/121 |
| 2,052,643 | 9/1936 | Modine | 126/121 |

FOREIGN PATENTS OR APPLICATIONS

| | | | |
|---|---|---|---|
| 900,622 | 7/1962 | United Kingdom | 126/121 |

*Primary Examiner*—Carroll B. Dority, Jr.
*Attorney, Agent, or Firm*—Clarence A. O'Brien; Harvey B. Jacobson

[57] ABSTRACT

A heat exchange device installed in a fireplace without any modification thereto completely encircling the fire, sides, top, back and bottom but without having the heating tubes and ducts exposed to the destructive concentrated heat that occurs at the fire bed level of grate or andiron and including twin cold air ducts extending from front to rear of the fireplace at one lower corner thereof, twin hot air ducts extending from front to rear of the fireplace at the other lower corner thereof with the twin ducts interconnected by a plurality of heat exchange tubes which extend upwardly along the side walls of the fireplace and then horizontally in overlying relation to the fire in the fireplace an additional tubes extending horizontally across the bottom of the fireplace. A motor driven fan is provided in the bottom cold air duct to circulate air through the device. The twin ducts, having interconnecting apertures to the rear, include baffle arrangements to guide the flow of air through the heat exchange tubes for most efficient utilization of the heat from the fire in the fireplace. A forced draft device is incorporated into the cold air duct for selective discharge of air at the base of the fire in the fireplace to facilitate the initial burning of the fuel and to provide a forced draft for proper combustion of the fuel whenever desired. When the fire is first lit, the resulting flames hitting and passing in between and around the overhead heating tubes encircling the fire provide heat almost instantly and as the fire progressively burns, the entire length of the heating tubes, both overhead and encircling the fire on both sides and to the back, become heated providing a continuous expanded volume of hot air which is forced out into the room, away from the fireplace, this air is then circulated and again reenters the cold air tubes by being forcibly drawn from the floor level and ejected as heated air on the opposite side of the fireplace. This results in an even room temperature, even at floor level. As the fire progressively burns, coals and ashes falling through the apertures in the conventional grate cover the heating tubes extending across the floor of the firepplace thereby extracting heat from this area of the fireplace which becomes heated last, but which also retains heat the longest, long after the fire itself has burned out.

8 Claims, 3 Drawing Figures

FIREPLACE HEATER

BACKGROUND OF THE INVENTION

1. Field of the Invention

The present invention generally relates to a heater installed in a fireplace for heating air circulated through the heater and discharging said heated air into a living space or spaces, thereby utilizing heat which is normally discharged up the chimney and rendering the fireplace substantially more effective for heating purposes.

2. Description of the Prior Art

Fireplaces are utilized in present day homes primarily for ornamental purposes and for the satisfaction derived from an open fire rather than for their capability of heating. However, in emergency situations, fireplaces frequently are relied upon for heating purposes. For example, if electrical power is interrupted or if fuel supply to the central heating system becomes depleted, a home owner must frequently rely upon the fireplace for heating purposes even though the inefficiency of a fireplace for heating is well known.

Various efforts have been made to render a fireplace more efficient for heating purposes. Such efforts include permanently installed heat exchange devices with air circulation means incorporated therein which are rather expensive in their initial cost and either must be installed when the fireplace is built or require substantial modification of the fireplace. In addition, efforts have been made to place a heat exchange device in the fireplace and circulate air through it for heating the air. Some devices of this nature combine the heat exchange device with the fuel supporting grate by constructing the grate of tubular pipe and circulating air therethrough. Such devices are not only inefficient heat exchangers but also have a very short useful life in view of the intense heat occurring at the grate especially when live coals are positioned on or under the grate, thus resulting in deterioration and burn-through of the pipes which then permit the air passing through the pipes to pickup sparks and products of combustion and discharge the same into the living space. Examples of heating devices associated with fireplaces in the prior art are found in the following U.S. patents:

| | |
|---|---|
| 1,112,521 | October 6, 1914 |
| 1,297,964 | March 18, 1919 |
| 1,783,140 | November 25, 1930 |
| 2,828,078 | March 25, 1958 |
| 3,001,521 | September 26, 1961 |
| 3,240,206 | March 15, 1966 |
| 3,635,211 | January 18, 1972 |
| 3,685,506 | August 22, 1972. |

SUMMARY OF THE INVENTION

An object of the present invention is to provide a fireplace heater in which the heat exchange tubes are oriented along both sides, across the top, back and bottom of the fireplace for most efficient heat exchange with the fire and products of combustion, with the heat exchange tubes being oriented in such a manner that they will not have any adverse effect upon the draft characteristics of the fireplace.

Another object of the invention is to provide a fireplace heater in which the heat exchange tubes have their lower ends connected respectively to cold air ducts at their inlet ends and hot air ducts at their discharge ends, with the cold air ducts having a powered fan associated therewith for circulating air with the fan being powered by an electric motor of the AC/DC type for connection with a conventional household electric power source or a battery, such as an automobile battery in the event electric power is interrupted.

A further object of the invention is to provide a fireplace heater in accordance with the preceding objects in which the cold air ducts and the hot air ducts include openings and a baffle arrangement, respectively, to guide the air therethrough and to direct the air to those tubes communicated with the cold air ducts for most efficient heat exchange and to guide the air in the hot air ducts in a manner so that most efficient heat exchange between the heater and the fire in the fireplace will be obtained.

Still another object of the invention is to provide a fireplace heater including a draft structure in the cold air ducts to enable discharge of air into the fireplace at the level of the grate or below the grate to provide a forced draft for the fireplace when desired.

Yet another significant object of the invention is to provide a fireplace heater in accordance with the preceding objects in which the heat exchange tubes extending across the upper end rear portion of the fireplace are arranged in a staggered relationship and are of oval-shaped configuration to more efficiently direct the hot combustion products into heat exchange relation to the external surfaces of the tubes.

Still another feature of the invention is the provision of a fireplace heater in accordance with the preceding objects in which the hot air ducts are provided with spark arresters to preclude the possibility of sparks being discharged from the fireplace heater even in the event a heat exchange tube rusts out due to condensation after prolonged use.

Yet another object of this invention is to provide a fireplace heater which can be installed in a fireplace without modification thereof with the usual grate, andirons and protective screen, glass door, or the like, being used in combination with the fireplace heater, thus enabling the benefits derived from an open fire to be obtained, while at the same time making efficient use of the heat produced by the fire in the fireplace rather than loosing such heat up the chimney to the atmosphere.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
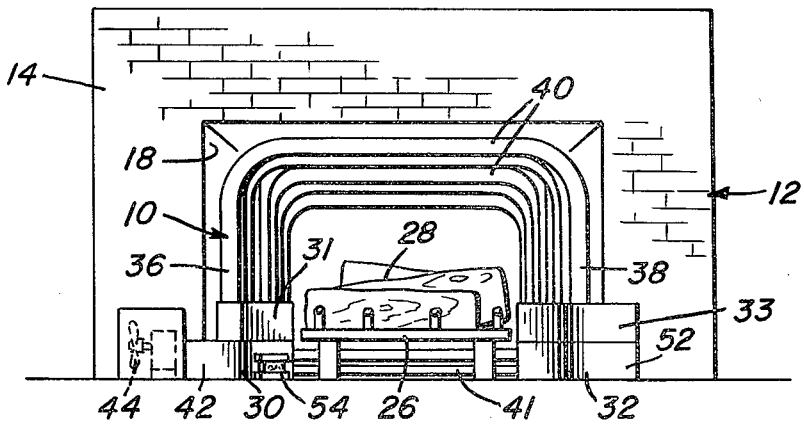
FIG. 1 is a front elevational view of a fireplace illustrating the fireplace heater of the present invention incorporated therein.
Figure 2:
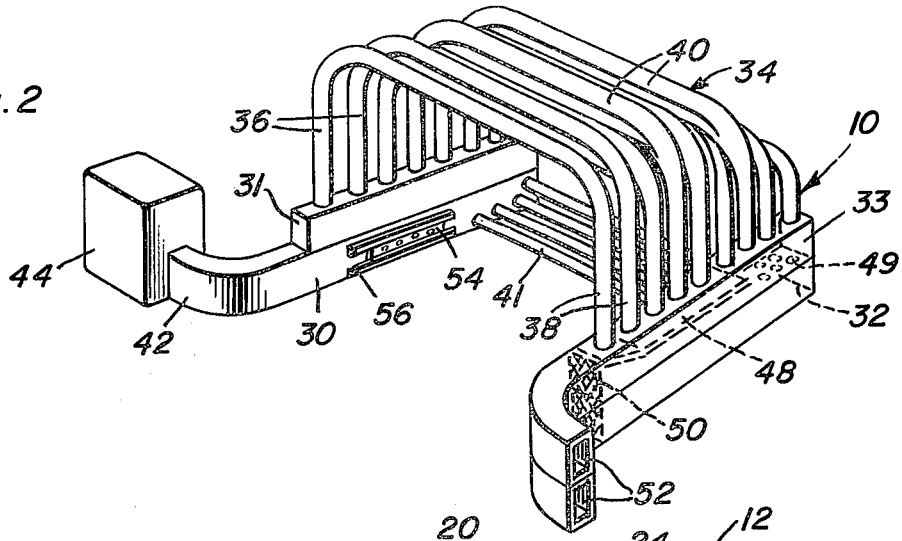
FIG. 2 is a perspective view of the fireplace heater.

Referring now specifically to the drawings, the fireplace heater of the present invention is generally designated by reference numeral 10 and is illustrated in combination with a conventional fireplace 12 having the usual facing 14, hearth 16, and opening 18. The top of the fireplace is communicated with a chimney having a passage 20 therein. The interior of the fireplace is lined with appropriate firebrick, or the like, and the rear wall 22 includes a forwardly inclined portion 24 which is provided to reflect heat downwardly and forwardly from the fireplace in a well known manner. As illustrated, the fireplace 12 is provided with the usual grate 26 for supporting wood 28 while it is burning and other conventional components may be provided in association with a fireplace, such as a damper in passage 20, andirons and a protective screen or transparent door across the open front 18 of the fireplace with these components not being illustrated. The fireplace heater 10 may be installed in the fireplace opening 18 with no modification whatsoever of the fireplace and with no changes in the normally provided grate and other associated structure. If a protective screen or door is employed, the lower corners thereof may be modified to receive the components of the fireplace heater which extend therethrough.

The fireplace heater 10 includes cold air ducts 30 and 31 which extend from front to rear at one lower corner of the fireplace and hot air ducts 32 and 33 generally parallel thereto and extending from front to rear at the other lower corner of the fireplace. The ducts 30, 31, 32 and 33 are rectangular with the twin tubes 30 and 31 and the twin tubes 32 and 33 being placed one above the other for maximizing the heat exchange efficiency. The upper ducts 31 and 33 catch or receive heat reflected from or radiated from the grate since they are generally aligned with the grate. The two upper ducts 31 and 33 are connected by a plurality of generally inverted U-shaped heat exchange tubes generally designated by numeral 34 with each of the heat exchange tubes including an upwardly extending leg 36 communicated with the cold air duct 31 and an upwardly extending leg 38 communicating with the hot air duct 33 and a horizontally disposed portion 40 communicating the upper ends of the legs 36 and 38 and disposed above the grate and fire thereon and extending generally across and parallel to the top surface of the fireplace.

Figure 3:
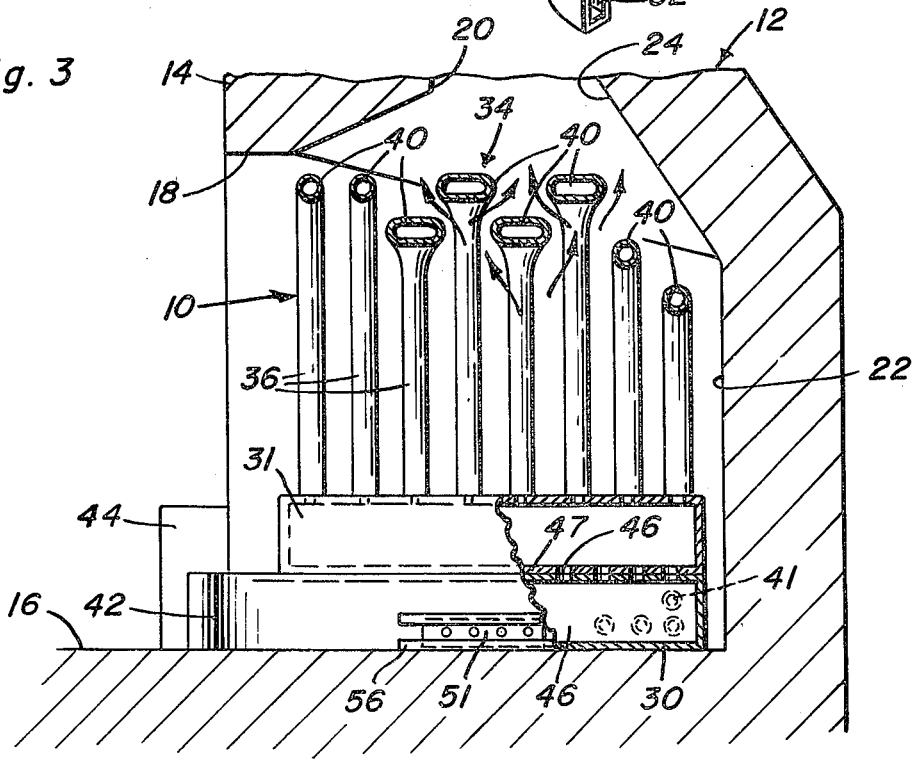
FIG. 3 is a vertical, sectional view of the fireplace heater and fireplace illustrating the association of the components of the heater and the fireplace.

The number of heat exchange tubes 34 may vary and the dimensions thereof also may vary depending upon the dimensional characteristics of the fireplace. As illustrated in FIG. 3, the horizontal portions 40 are oriented in vertically staggered relationship, that is, adjacent horizontal portions being vertically spaced in relation to each other. Also, at least the centrally oriented horizontal portions 40 are flattened into an oval-shaped configuration so that the heated gases or combustion products which pass upwardly toward the chimney passage 20 will impinge upon the surfaces of the horizontal portions 40 and the oval-shaped configuration of the horizontal portions 40 will deflect the gases and products of combustion laterally to engage the adjacent horizontal portions 40 as illustrated by the directional arrows in FIG. 3. All of the horizontal portions 40 may be flattened, if desired, or only the central horizontal portions may be flattened where the hottest combustion products pass. The rearmost horizontal portions 40 are located below the horizontal portions 40 adjacent the front end of the fireplace heater as illustrated in FIG. 3 so that they will generally conform with the forwardly inclined portion 24 of the fireplace and the elevational position of the rear horizontal portions 40 may be varied depending upon the shape and configuration of the rear wall of the fireplace. A plurality of bottom heating tubes 41 extend between and communicate with the lower ducts 30 and 32 and are disposed adjacent the floor of the fireplace so that these tubes will be in heat exchange relation with live coals, or the like, even after a fire has died down, thus enabling air to be heated substantially after a fire has died down but yet live coals remain on the grate or in the bottom of the fireplace.

The forward end of the lower cold air duct 30 curves laterally outwardly at 42 and is in communication with a fan assembly 44 schematically illustrated which includes a housing provided with sound deadening material and a fan powered by an AC/DC motor with the housing having an air inlet which may be provided with a screen or filter, if desired, or the fan may be connected with any suitable duct work rather than being directly communicated with the room in which the fireplace is installed. The AC/DC motor enables the fan to be operated even if normal electrical power is interrupted by using a conventional 6 or 12 volt automobile battery or any other suitable battery. Also, the cold air ducts 30 and 31 are communicated with each other through a plurality of openings 46 in the contacting walls 47 (see FIG. 3) in which the walls 47 define a baffle for the cold air which guides the cold air rearwardly up through the openings 46 into the upper cold air duct 31 and then upwardly through the heat exchange tubes 34 with the rearward heat exchange tubes 34 receiving the cold air first inasmuch as the rearward heat exchange tubes are hotter than the forward heat exchange tubes thereby increasing the efficiency of heat transfer to the cold air passing through the heat exchange tubes since the coldest air will pass through the hottest heat exchange tubes thereby increasing the heat exchange efficiency of the heater.

The upper hot air duct 33 is provided with a centrally disposed baffle 48 so that air being discharged from the forwardmost heat exchange tubes 34 will pass rearwardly along the top of the baffle 48 and around the rear edge thereof with all of the air from all of the heat exchange tubes being mixed and intermingled. The hot air passing rearwardly and then forwardly in the upper hot air duct 33 will continue to receive heat since the upper hot air duct 33 itself is a heat exchange tube thereby further increasing the efficiency of heat exchange and providing mixed hot air so that all of the air will be at the same temperature. The contacting walls of the hot air ducts 32 and 33 have holes 49 therein, at the rear, so that a portion of the hot air from duct 33 enters the rear portion of duct 32 and moves forwardly therein. The lower duct 32 is also a heat exchange tube and will further heat the air as it passes therethrough. Also, the forward portion of each of the hot air ducts 32 and 33 is provided with a spark arrester 50 in the form of a screen, or the like, to prevent the possibility of any sparks being discharged from the hot air ducts even if one of the heat exchange tubes rusts our due to condensation after prolonged use. The forward end of the hot air ducts 32 and 33 extend laterally and include outlets 52 or they may be connected with any suitable type of duct work or the like to convey the hot air to any desired location, such as into another room or into a duct work in the house, or the like. Thus, the fan and cold air duct 30 forcibly bring in air at a desired rate, such as from 150–160 cfm, to feed air to the heating tubes. As the air is heated, it expands, thus requiring a larger outlet for quick dispersal which is obtained by using discharge outlets in both hot air ducts 33 and 32.

To provide a forced draft for the fireplace to facilitate the starting of a fire and to facilitate burning of wet or uncured wood, or the like, the lower cold air duct 30 is provided with a sliding damper 54 having a plurality of holes therein for alignment with and misalignment with holes in the cold air duct 30. The sliding damper 54 is received in suitable horizontal tracks 56 and may be actuated by a poker or other tool so that it may be moved to an open position for discharging air from the cold air duct 30 into the fireplace at a level below the grate thereby providing for easy starting of a fire and instant draft thus helping to eliminate the buildup of smoke and gases which sometimes occurs when the fire is first started. Also, the forced draft makes possible the burning of wood that may be partially wet or uncured and assist in getting a fire burning rapidly in a short period of time and also boosting a fire so that it will burn brightly when desired.

The heater is constructed of suitable metal material with the components thereof being secured together in a suitable manner with the thickness and strength of the materials being commensurate with the requirements of the installation. The heater extracts cold air from the floor off to the side of the fireplace, heats the air and expels the hot air out at the bottom of the fireplace either directly into the room or the heated air may be ducted to any portion of a house through relatively inexpensive ducting or by use of an existing duct system. It is possible that all of the intakes and outlets outside of the screen may be hidden from view by building air passages into the raised hearth of a fireplace. The positioning of the heating tubes and their configuration are such that the greatest amount of heat will be extracted from the fireplace without diminishing the draft up the chimney, thereby retaining the operational characteristics of the fireplace insofar as smoke and gas discharge is concerned. The blower and motor are positioned away from the fireplace to eliminate any adverse effects upon the blower and motor by the heat of the fireplace and enables even a minimum size fire to effectively heat a room or the like with all of the pleasures derived from an open fire in the fireplace being retained and with the attractive appearance characteristics of the fireplace also being retained inasmuch as the fireplace heater is generally substantially concealed especially if a protective screen, door or the like is used across the opening in the fireplace as is conventional.

This fireplace heater has been proven to be a most efficient means of heating, not to replace a conventional heating system, but a most efficient supplement, reducing drastically the fuel consumption ordinarily needed, while at the same time, providing the enjoyment and relaxation that an open fire in a fireplace provides, making a fireplace very beneficial in every day life and truly a life saver in an emergency, giving a definite measure of security and peace of mind as a safeguard in time of emergency caused by electrical failure or blackout or because regular fuel supplies are not obtainable. Design readily makes possible larger models for lodges and circular type fireplaces, as well. Our invention envisions using the same idea on encircling large fireplaces of a round design used in large rooms or areas, as lodges. The heating tubes would surround the fire, all but the front, and be of a configuration to match the fireplace. In a very large fireplace, two or three units, each with a cold air intake and each with a hot air outlet, could be used, again catching the heat before it disappears out the chimney flue. In this way a large lodge could very well get by with this means of heating entirely. This same idea can be used for efficient hot water heating, substituting the air ducts and tubes with pipes suitable for containing water with circulating water pump replacing the air blower, pipes connected to radiators or piped into existing hot water heating systems.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A heater for installation in a fireplace comprising cold air duct means adapted to be oriented adjacent one lower corner of the fireplace, hot air duct means adapted to be oriented adjacent the other lower corner of the fireplace and adapted to extend from front to rear of the fireplace, a plurality of heat exchange tubes interconnecting the cold air duct means and the hot air duct means and extending upwardly and transversely and adapted to be disposed in overlying relation to a fire in the fireplace so that heat from the fire and the products of combustion of the fire will pass over and around the heat exchange tubes for heating air passing therethrough from the cold air duct means to the hot air duct means, and means moving air through the heater from the cold air duct means, through the heat exchange tubes to the hot air duct means for discharge of hot air therefrom, said cold air duct means including twin ducts disposed in superimposed relation with communicating apertures at the rear thereof for guiding cold air rearwardly in the bottom duct, up through the apertures into the top duct, said heat exchange tubes being connected to the top duct for discharge of coldest air from the cold air duct means into the heat exchange tubes that are the hottest, thereby increasing the heat exchange efficiency of the heat exchange tubes.

2. The structure as defined in claim 1 wherein each of said heat exchange tubes includes a generally horizontally disposed portion adapted to be disposed adjacent to and generally parallel with the interior surface of the fireplace above and in parallel relation to a fireplace grate on which a fire may burn, said horizontal portions of the heat exchange tubes being in alternating vertically staggered position for more efficient impingement of hot gases and combustion products thereon from a fire and for more efficient heat exchange between the air passing through the heat exchange tubes and the hot gases and combustion products passing over the exterior surfaces thereof.

3. The structure as defined in claim 2 wherein said horizontal portions of the heat exchange tubes are of generally oval-shaped configuration with the major dimension of the oval-shaped configuration adapted to extend from front to rear of the fireplace for deflecting hot gases from the horizontal portions of the lower heat exchange tubes toward the horizontal portions of the upper heat exchange tubes.

4. The structure as defined in claim 1 wherein said means for circulating air through the heater includes a fan assembly associated with the cold air duct means, said fan assembly including a fan and AC/DC motor for powering the fan from household electric current or an automobile battery when electrical power is interrupted.

5. The structure as defined in claim 1 wherein said cold air duct means includes a damper means adapted to selectively discharge a forced draft of air into the fireplace adjacent the grate to facilitate the starting of a fire and to facilitate burning of wet or uncured wood, or the like.

6. The structure as defined in claim 1 together with heat exchange tubes extending horizontally between the duct means and adapted to be disposed adjacent the bottom of a fireplace whereby air passing therethrough will be heated by live coals thereon and adjacent thereto for a substantial period of time after the fire in the fireplace has died down.

7. A heater for installation in a fireplace comprising cold air duct means adapted to be oriented adjacent one lower corner of the fireplace, hot air duct means adapted to be oriented adjacent the other lower corner of the fireplace and adapted to extend from front to rear of the fireplace, a plurality of heat exchange tubes interconnecting the cold air duct means and the hot air duct means and extending upwardly and transversely and adapted to be disposed in overlying relation to a fire in the fireplace so that heat from the fire and the products of combustion of the fire will pass over and around the heat exchange tubes for heating air passing therethrough from the cold air duct means to the hot air duct means, and means moving air through the heater from the cold air duct means, through the heat exchange tubes to the hot air duct means for discharge of hot air therefrom, said hot air duct means including twin ducts disposed in superimposed relation with communicating apertures at the rear thereof and an outlet at the forward end of each duct, a spark arrester in each duct adjacent the forward outlet end thereof, the top hot air duct also including a baffle whereby air discharged from the heat exchange tubes must pass rearwardly around the baffle with a portion of the hot air then passing forwardly to the outlet therein and the remainder of the hot air passing through the apertures into the bottom air duct and out the outlet.

8. In combination with a fireplace having a generally horizontal bottom with a supporting grate means thereon for supporting combustible material above the bottom, upwardly extending side and rear walls, an open front by which the combustible material may be placed in position on the grate means for burning and an upwardly extending exhaust chimney means for combustion products, a heat exchange assembly independent from the fireplace and grate means comprising a cold air duct means positioned along the bottom of the fireplace adjacent one sidewall thereof and extending from the open front to a point adjacent the rear wall alongside said grate means, a hot air duct means paralleling said cold air duct means adjacent the other side wall of the fireplace and positioned along the bottom of the fireplace alongside the grate means, a plurality of heat exchange tubes extending generally horizontally above the combustible material on the grate means and below the chimney means, each end of each tube having a depending portion disposed adjacent the side walls of the fireplace and having their lower ends anchored to and communicated with the cold and hot air duct means respectively and disposed adjacent the grate means, means circulating air through the duct means and the heat exchange tubes, said means including cold air inlet means in the cold air duct means adjacent a lower end portion of the open front of the fireplace and hot air outlet means in the hot air duct means adjacent the other lower end portion of the open front of the fireplace, said grate means being removable from the fireplace independently of the cold and hot air duct means and independently of the heat exchange tubes, said heat exchange tubes being spaced from each other and disposed substantially throughout the top and side walls of the fireplace from the open front thereof to the rear wall, said hot air outlet means being of a larger volume than the cold air inlet means thereby enabling air to expand in the duct means and heat exchange tubes and to be discharged at a higher volume, each of said air duct means having a substantial portion below the grate means, one of said duct means including a damper controlled discharge means on the inner surface thereof below the grate means for discharging combustion supporting air under the grate means, said cold air inlet means including fan means associated therewith for providing a positive pressure for operating the heat exchange assembly, each of said air duct means including baffle means to provide a tortuous air path therethrough, and a plurality of transversely extending tubes interconnecting the rearmost ends of the cold and hot air duct means respectively with such tubes being oriented below the grate means for heat exchange association with coals and hot ashes deposited on the bottom of the fireplace from the grate means.

* * * * *